US011011873B2

(12) United States Patent
Peloza et al.

(10) Patent No.: US 11,011,873 B2
(45) Date of Patent: May 18, 2021

(54) CONNECTOR ASSEMBLY

(71) Applicant: Molex, LLC, Lisle, IL (US)

(72) Inventors: Kirk B. Peloza, Lisle, IL (US); Augusto Panella, Lisle, IL (US); Dino L. McLaughlin, Jr., Lisle, IL (US); Pu Xie, Lisle, IL (US); David L. Brunker, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/493,306

(22) PCT Filed: Mar. 15, 2018

(86) PCT No.: PCT/US2018/022556
§ 371 (c)(1),
(2) Date: Sep. 12, 2019

(87) PCT Pub. No.: WO2018/170209
PCT Pub. Date: Sep. 20, 2018

(65) Prior Publication Data

US 2020/0083627 A1 Mar. 12, 2020

Related U.S. Application Data

(60) Provisional application No. 62/472,945, filed on Mar. 17, 2017.

(51) Int. Cl.
*H01R 13/64* (2006.01)
*H01R 13/6471* (2011.01)
(Continued)

(52) U.S. Cl.
CPC ..... *H01R 13/6471* (2013.01); *H01R 13/6587* (2013.01); *H01R 12/75* (2013.01); *H01R 13/629* (2013.01); *H01R 13/6275* (2013.01)

(58) Field of Classification Search
None
See application file for complete search history.

(56) References Cited

U.S. PATENT DOCUMENTS 6,380,485 B1 4/2002 Beaman et al.
6,663,429 B1 12/2003 Korsunsky et al.
(Continued)

FOREIGN PATENT DOCUMENTS

CN 103378494 A 10/2013
CN 105612671 A 5/2016
(Continued)

OTHER PUBLICATIONS

International Search Report and Written Opinion received for PCT application No. PCT/US2018/022556, dated Jun. 28, 2018, 9 pages.
(Continued)

*Primary Examiner* — Ross N Gushi

(57) ABSTRACT

The described connector assemblies are useful in wire-to-board systems. The assemblies which include a free-end connector that is attached to a twin-ax cable, and a fixed-end connector that is attached to a board. Embodiments include a free-end terminal set including a first signal terminal, a second signal terminal and a ground plate. The ground plate has a horseshoe shape and provides a ground terminal on opposing sides of the first and second signal terminals. Additionally, embodiments include a locking system between the free-end connector and fixed-end connector, and lead designs for the fixed-end connector utilizing a similar horseshoe shape as that used for the ground plate of the free-end connector.

23 Claims, 21 Drawing Sheets

(51) Int. Cl.

| | |
|---|---|
| ***H01R 13/6587*** | (2011.01) |
| *H01R 12/75* | (2011.01) |
| *H01R 13/627* | (2006.01) |
| *H01R 13/629* | (2006.01) |

(56) References Cited

U.S. PATENT DOCUMENTS

| | | | | |
|---|---|---|---|---|
| 7,104,824 | B2 | 9/2006 | Kuroki | |
| 7,497,724 | B1 | 3/2009 | Fong et al. | |
| 8,449,330 | B1 * | 5/2013 | Schroll | H01R 13/514 439/607.06 |
| 8,550,861 | B2 | 10/2013 | Cohen et al. | |
| 8,888,530 | B2 * | 11/2014 | Trout | H01R 13/6587 439/607.07 |
| 2012/0115370 | A1 | 5/2012 | Hsueh et al. | |
| 2014/0138154 | A1 | 5/2014 | Sugiyama | |
| 2015/0147906 | A1 | 5/2015 | Guetig et al. | |

FOREIGN PATENT DOCUMENTS

| | | | |
|---|---|---|---|
| CN | 105938945 | A | 9/2016 |
| CN | 105979452 | A | 9/2016 |
| JP | S52-144388 | U | 11/1977 |
| JP | 2004-031257 | A | 1/2004 |
| JP | 2010-108848 | A | 5/2010 |
| JP | 2015513207 | A | 4/2015 |
| TW | M375336 | U | 3/2010 |
| TW | I475770 | B | 3/2015 |
| WO | 2011031311 | A2 | 3/2011 |
| WO | 2018/170209 | A1 | 9/2018 |

OTHER PUBLICATIONS

Notification of Reasons for Refusal received for JP application No. 2019-548746, dated Aug. 25, 2020, 6 pages. (3 pages of english translation and 3 pages of official copy).

Decision to Grant received for JP Application No. 2019-548746, dated Apr. 6, 2021, 5 Pages.( 2 pages Of English Translation and 3 Pages Of Official Communication).

* cited by examiner

CONNECTOR ASSEMBLY

This application claims priority to PCT Application No. PCT/US2018/022556, filed on Mar. 15, 2018, which claims the benefit of U.S. Provisional Application No. 62/472,945, filed Mar. 17, 2017, both of which are incorporated herein by reference in their its entirety.

TECHNICAL FIELD

This disclosure relates to the field of input/output (IO) connectors, more specifically to IO connectors suitable for use in high data rate applications.

DESCRIPTION OF RELATED ART

Input/output (IO) connectors can be designed for a variety of systems, including board-to-board, wire-to-wire and wire-to-board systems. A wire-to-board system includes a free-end connector that is attached to a wire, and a fixed-end connector that is attached to a board. A wide range of suitable designs exist for each type of system, depending on requirements and the environment where the connectors are intended to be used.

For applications where data rates are going to be high and space is restricted, however, a number of competing requirements make the connector design more challenging. High data rates (data rates equal to or above 25 Gbps) typically use differentially coupled signal pairs to help provide greater resistance to spurious signals and preferably have sufficient space to avoid creating inadvertent signaling modes with adjacent differently coupled signals pairs. In the connector interface, ground terminals can be added to create a return path and to provide shielding between differential pairs. However, if space is a problem then it becomes desirable to shrink the pitch of the connector and bring all the terminals closer together (which tends to increase the cross talk). Many individuals would appreciate a wire-to-board connector design that allows for high performance while taking up limited space.

SUMMARY

A wire-to-board system is disclosed that can be provided in compact configuration that supports high data rates. A fixed-end connector includes an opening with a plurality of terminals positioned in the opening. The terminals include tails that are configured to be connected to a circuit board and in one configuration can be soldered to the circuit board. A free-end connector includes a housing that supports a twin-ax cable and includes a frame that supports terminals on one side. Conductors from the twin-ax cable can pass through the frame and be terminated to conductor apertures in the terminals. A shield cover can be used to provide shield for differentially coupled signal pairs.

In one aspect of the above wire-to-board system, there is a connector assembly comprising a free-end connector. The free-end connector has a twin-ax cable, a connector housing, a frame and a terminal set.

The twin-ax cable includes a first conductor and a second conductor spaced apart and surrounded by an insulative material, and includes a drain wire and outer covering. The first conductor, second conductor and drain wire each have an exposed distal end extending from the insulative material and outer covering. The connector housing supports the twin-ax cable.

The frame is positioned in the connector housing and has a first side and a second side opposite the first side. The frame includes a plurality of frame apertures extending from the first side to the second side.

The terminal set is supported on the second side of the frame. The terminal set includes a first signal terminal, a second signal terminal and a ground plate. The ground plate has a horseshoe shape and provides a ground terminal on opposing sides of the first and second signal terminals. The first conductor extends through a first aperture of the plurality of frame apertures and is connected to the first signal terminal. The second conductor extends through a second aperture of the plurality of fame apertures and is connected to the second signal terminal. The drain wire extends through a third aperture of the plurality of frame apertures and is connected to the ground plate.

In the above embodiments, the plurality of frame apertures can be tapered so as to facilitate the movement of the distal end of the conductors and drain wire from the first side to the second side of the frame during insertion.

Also, the ground plate and the first and second signal terminals can have conductor apertures aligned with the tapered apertures. The first conductor can be connected at the conductor aperture to the first signal terminal, the second conductor can be connected at the conductor aperture to the second signal terminal, and the drain wire can be connected at the conductor aperture to the ground plate. The connection can be by welding, including soldering, the first conductor to the first signal terminal at the conductor aperture, and the second conductor to the second signal terminal at the conductor aperture.

Additionally, the free-end connector can comprise a shield cover positioned over the first and second signal terminals and connected to the ground plate. The shield cover can include a first tuning aperture aligned with the conductor aperture in the first signal terminal, and a second tuning aperture aligned with the conductor aperture in the second signal terminal.

In some embodiments there is a connector system comprising a free-end connector and a fixed-end connector. The free-end connector has a connector housing, and the fixed-end connector has a plug housing. The connector housing and fixed-end connector are configured to connect together. The connector housing and plug housing can interlock by interaction of a leaf spring and locking ledge. In these embodiments, the connector housing can include the leaf spring that interlocks with the locking ledge on the plug housing. Additionally, the plug housing can further comprise block guides so as to provide at least one block guide on opposing sides of the locking ledge. Further, the leaf spring can extend longitudinally farther from the connector housing than the terminal set such that the leaf spring is guided by the block guides so as to prevent the terminal set from contacting the plug housing during connecting of the free-end connector to the fixed-end connector.

In some of the above embodiments, the fixed-end connector further comprises a plug wafer, a ground lead frame and a pair of signal leads. The plug wafer is positioned in the plug housing, and the ground lead frame is carried on the plug wafer. The ground lead frame has a horseshoe shape. The pair of signal leads is positioned within said ground lead frame so that there are ground leads on opposing sides of the pair of signal leads. The ground lead frame is in electrical contact with the ground terminal. Also, one of the signal leads is in contact with the first signal terminal and the other signal lead is in contact with the second signal terminal.

In some embodiments, a first signal lead of the pair of signal leads has a PCB contact end and a straight beam portion extending perpendicular to the PCB contact end. The straight beam portion has a single cantilever forming a bend such that a second end extends at an angle from the straight beam portion. The first signal terminal is a straight beam having a first end, a second end and a single cantilever such that the second end extends at an angle from the straight beam and the first end is in line with the straight beam. In such embodiments, when the plug housing and connector housing are connected, the first signal lead contacts the first signal terminal at a contact point resulting in a primary stub length and secondary stub length of about equal length.

In another aspect, there is a method of producing a connector assembly comprising:

providing a twin-ax cable including a first conductor and second conductor surrounded by an insulative material, and including a drain wire;

dressing the cable whereby a distal end of the first conductor, a distal end of the second conductor and a distal end of the drain wire are exposed;

inserting the distal end of the first conductor through a first aperture in a frame in a connector housing, inserting the distal end of second conductor through a second aperture in the frame and inserting the distal end of the drain wire through a third aperture in the frame, wherein the first, second and third apertures are tapered so as to facilitate the movement of each distal end from a first side to a second side of the frame during insertion;

thereafter, inserting the distal end of the first conductor through a first conductor aperture in a first signal terminal of a terminal set supported on the second side of the frame, inserting the distal end of the second conductor through a second conductor aperture in a second signal terminal of the terminal set, and inserting the distal end of the drain wire through a third conductor aperture in a ground plate of the terminal set, wherein the ground plate has a horseshoe shape and provides a ground terminal on opposing sides of the first and second signal terminals; and placing the distal end of the first conductor in contact with the first signal terminal, placing the distal end of the second conductor in contact with the second signal terminal, and placing the drain wire in contact with the ground plate.

The method can further comprise placing a shield cover over the first and second signal terminals so that the shield cover is connected to the ground plate.

Also, the method can further comprise welding the first conductor to the first signal terminal at the first conductor aperture, welding the second conductor to the second signal terminal at the second conductor aperture and welding the drain wire to the ground plate at the third conductor aperture.

In some embodiments, the method comprises introducing a leaf spring on the connector housing to a block guide on a plug housing, wherein the leaf spring extends longitudinally farther from the connector housing than the terminal set such that the leaf spring is guided by the block guides that help prevent the terminal set from contacting the plug housing during connection of the connector housing to the plug housing. Thereafter, the connector housing is connected to the plug housing by interlocking the leaf spring with a locking ledge on the plug housing.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and the features disclosed are not intended to be limited to the expressly disclosed combination(s). Therefore, unless otherwise noted, features disclosed herein may be combined together to form additional combinations that were not otherwise shown for purposes of brevity.

Figure 1:
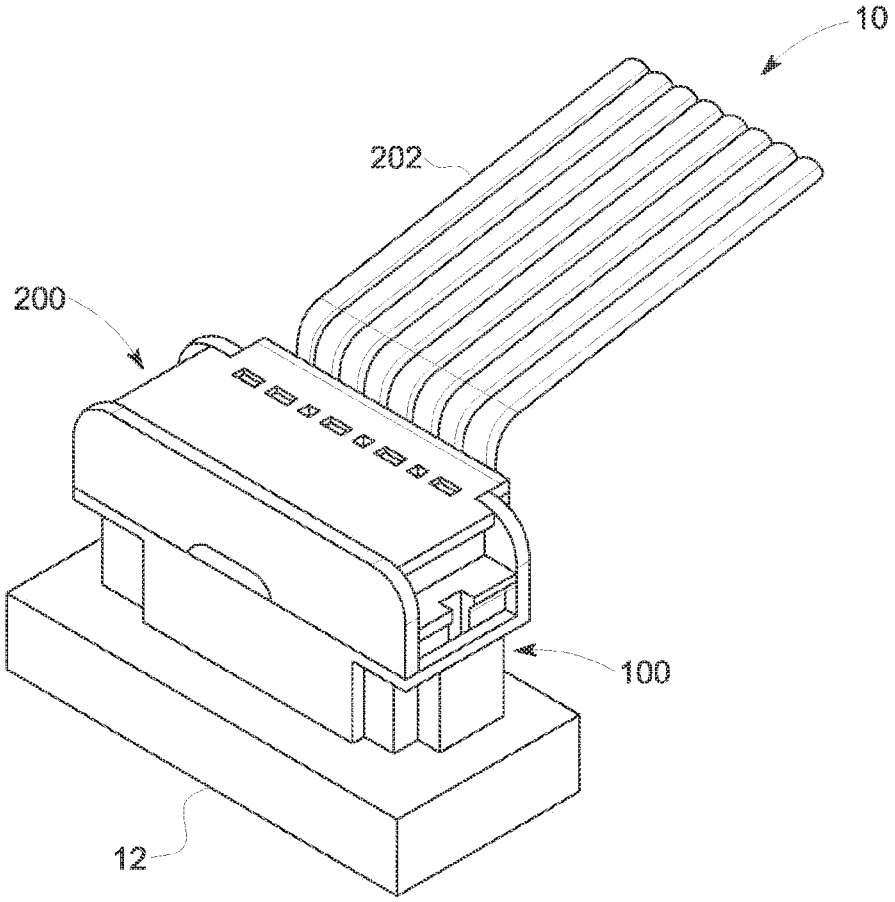
FIG. 1 is a perspective view of an embodiment of a connector system.
Figure 2:
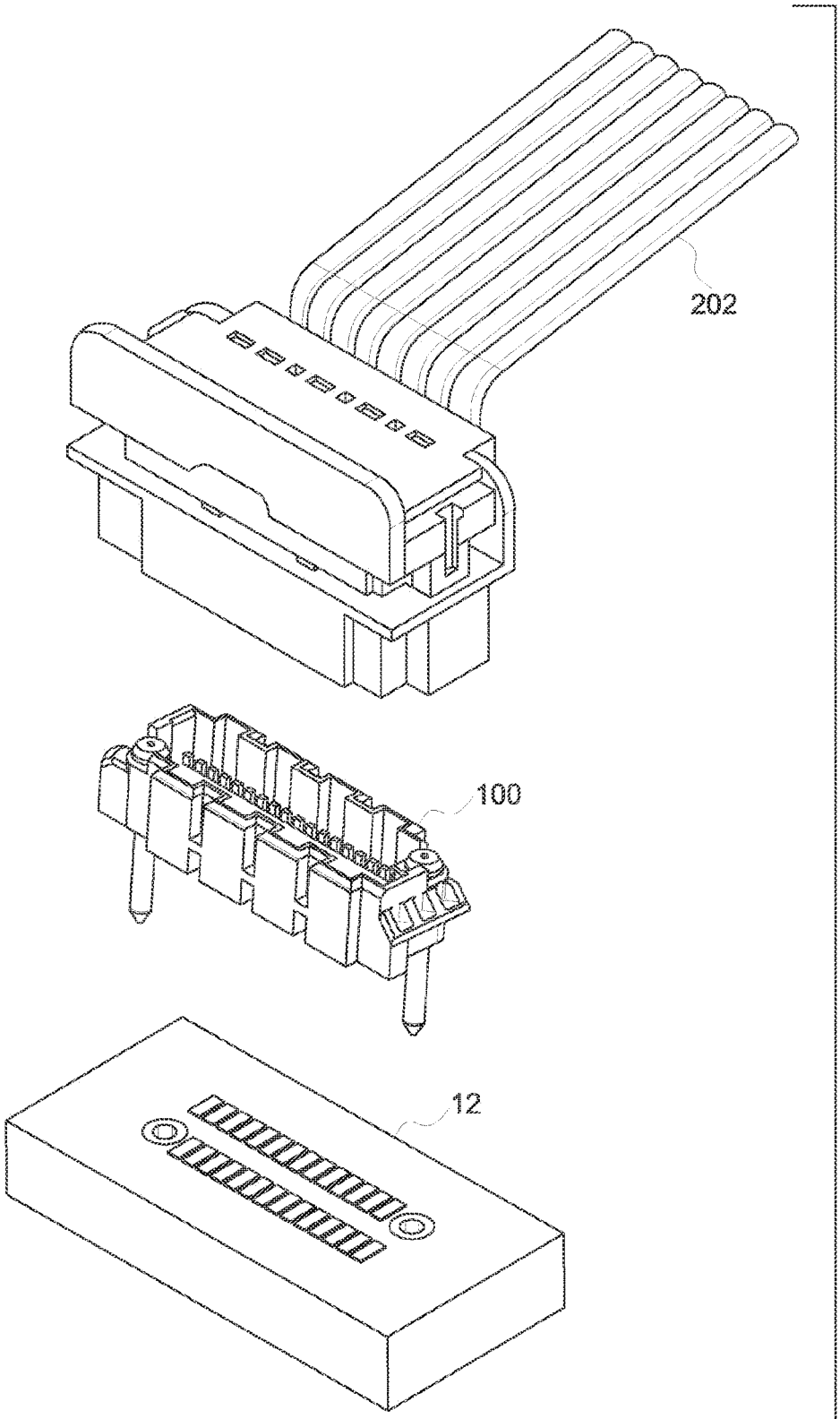
FIG. 2 is an exploded view of the components of the connector assembly illustrated in FIG. 1.

As can be appreciated from FIGS. 1 and 2, the current disclosure relates to a wire-to-board connector system 10, the system can be configured with a free-end connector 200 that mates to a fixed-end connector 100. Free-end connector 200 can have a twin-ax cable 202 that extends out vertically compared to a horizontal board, such as circuit board 12. As can be appreciated, free-end connector 200 can also have cable 202 extend out horizontally. Naturally, cable 202 can extend out at some angle between vertical and horizontal as desired.

Figure 3:
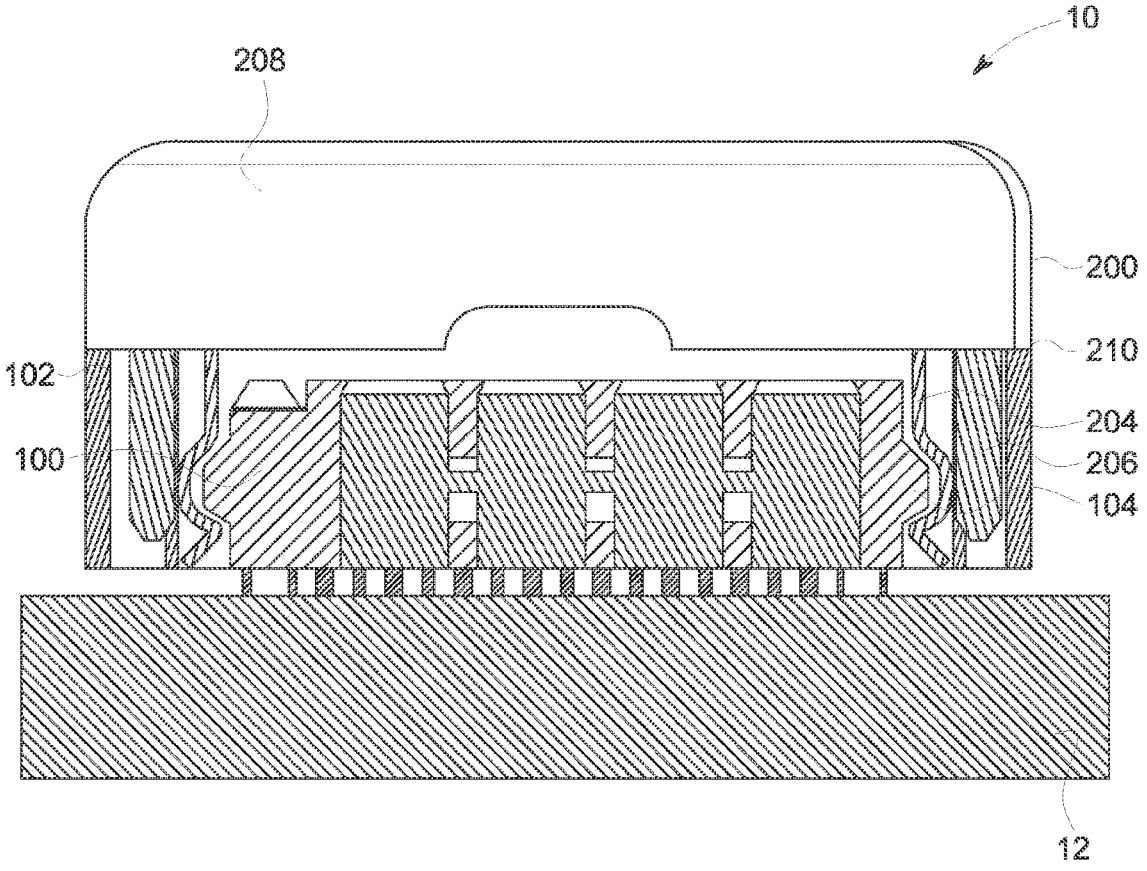
FIG. 3 is a front view of the connector assembly of FIG. 1 with partial cut-a-way.
Figure 4:
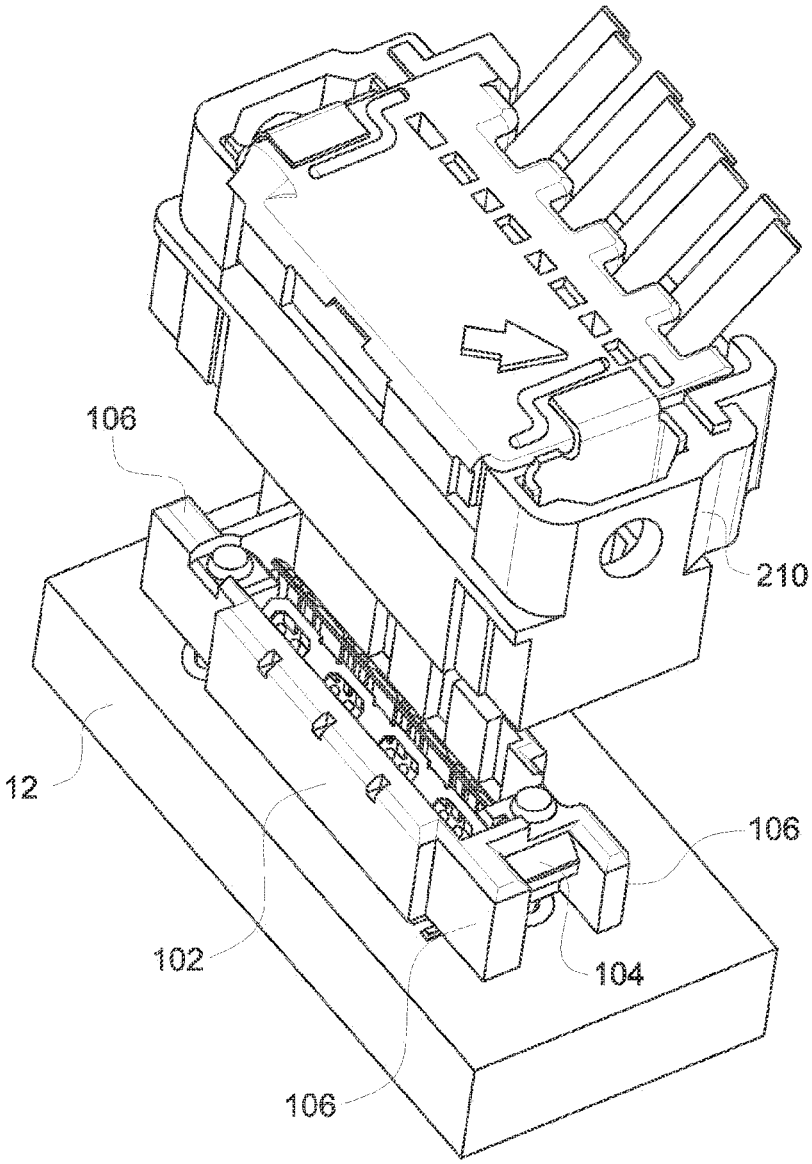
FIG. 4. is a perspective view of another embodiment of a connector system.
Figure 5:
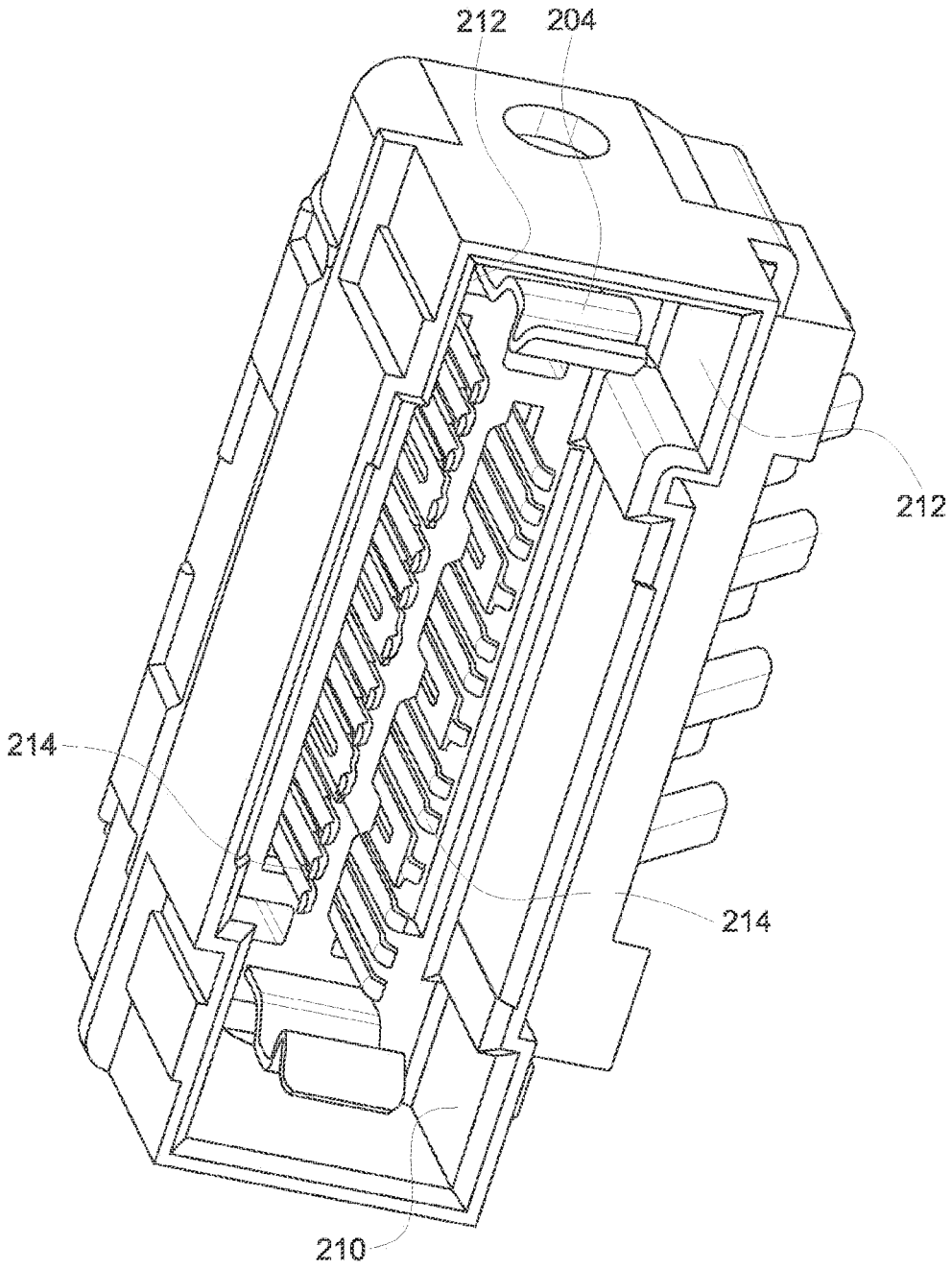
FIG. 5 is perspective bottom view of the free-end connector portion of the connector system illustrated in FIG. 4
Figure 6:
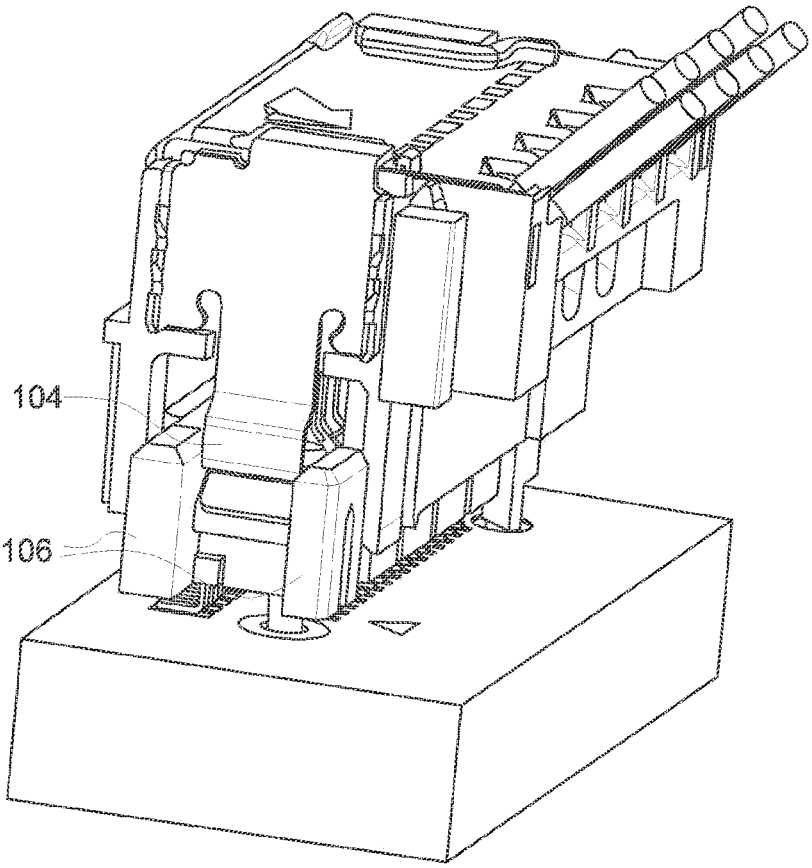
FIG. 6 is a perspective view of the connection of the free-end connector to the fixed-end connector with portions of the connector housing and plug housing removed to better illustrate the connection.

System 10 can include a locking system, such as is depicted in FIG. 3, to ensure that a leaf spring 204 is retained locked against a retaining shoulder 104. In an embodiment the locking system includes leaf spring 204 attached to connector housing 210 of free-end connector 200. It further includes a retaining shoulder or locking ledge 104 on plug housing 102 of fixed-end connector 100. Leaf spring 204 is positioned on connector housing 210 so that it slides over locking ledge 104 when connector housing 210 is placed over plug housing 102.

The depicted locking system further includes retention fingers 206 attached to a translatable platform 208. Translatable platform 208 is configured to be slideable up and down so as to move retention fingers 206 up and down. Thus, when the connector housing 210 of free-end connector 200 is brought in place over plug housing 102 of fixed-end connector 100, leaf spring 204 slides down over locking ledge 104. Next, translatable platform 208 is slid downward, which slides retention fingers 206 downward, thus locking leaf spring 204 over locking ledge 104 on plug housing 102.

Once slid downward into place, retention fingers 206 prevent leaf spring 204 from being detached from locking ledge 104. While other known latching systems could be used, the advantage of the depicted system is that limited additional space is needed and retention fingers 206 can be part of translatable platform 208, which can easily be determined to be in position. Alternatively, the connector system can solely rely on leaf spring 204 and the locking feature can be omitted.

Turning now to FIGS. 4-8, a guiding system is shown, which prevents damage to terminals during connection of the free-end connector to the fixed-end connector. The guiding system illustrated may be used with or separate from the locking system described above. As seen from FIGS. 4 and 5, the guiding system utilizes block guides 106 formed as part of plug housing 102. Block guides 106 are positioned on opposing sides of locking ledge 104. Connector housing 210 is configured to receive block guides 106 in spaces 212, which are on opposing sides of leaf spring 104. As best seen from FIG. 6, block guides 106 are on opposing sides of leaf spring 204 when connector housing 210 and plug housing 102 are connected. As depicted, two locking ledges are provided on opposing sides of the housing 102 and the block guides 106 thus define two channels on opposite sides of the connector housing.

Figure 7:
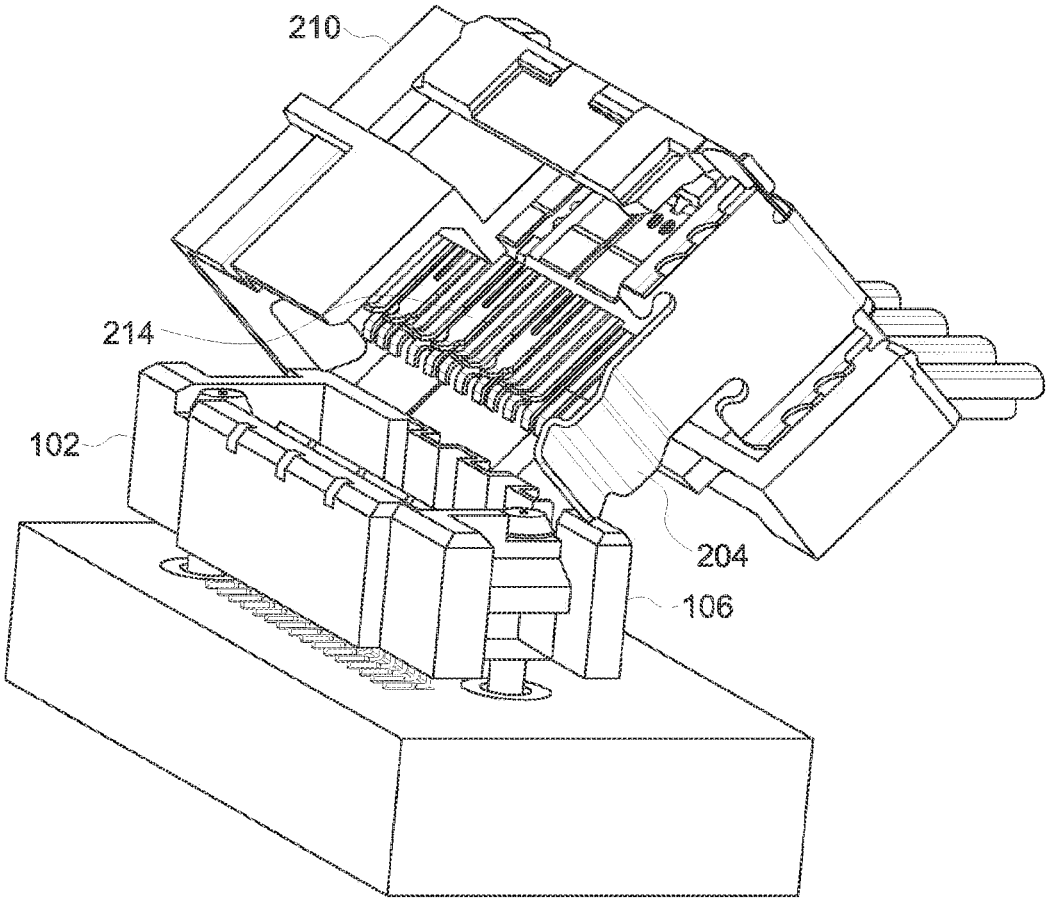
FIG. 7 is perspective view of the connection system during connection of the free-end connector to the fixed-end connector with portions of the connector housing and plug housing removed to better illustrate the connection.
Figure 8:
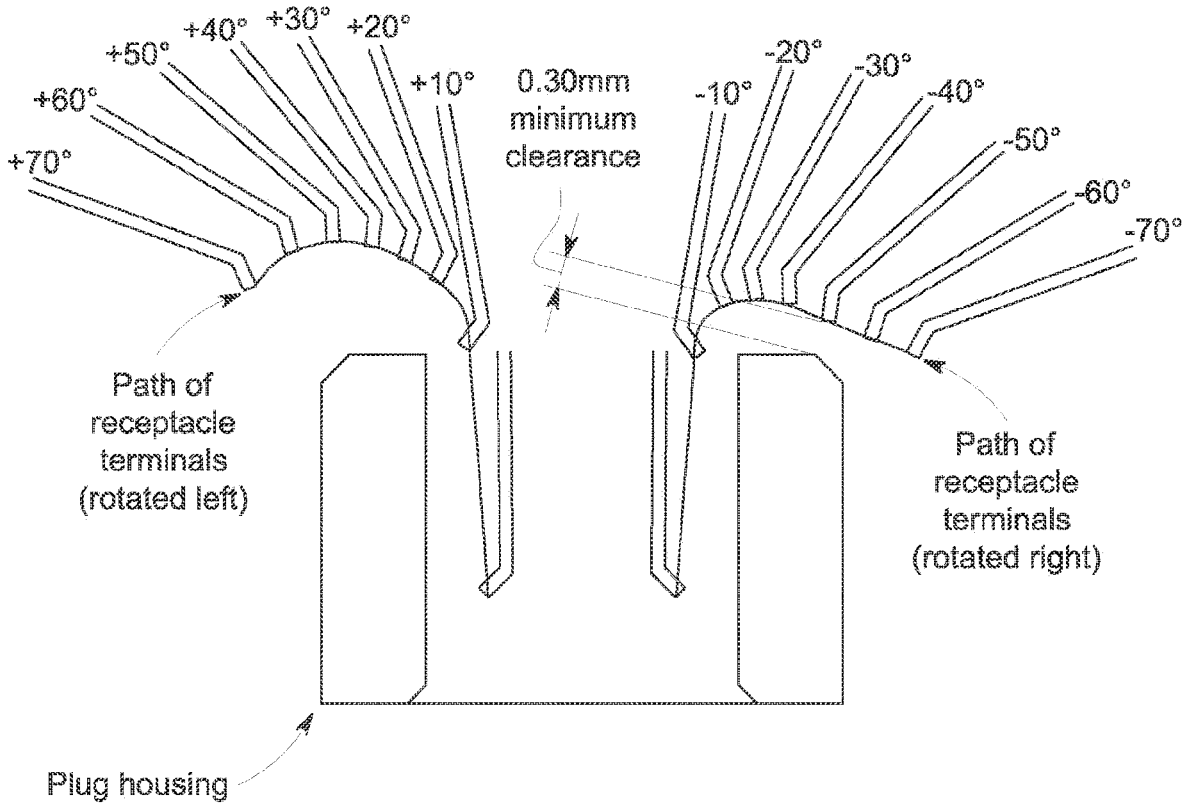
FIG. 8 is a diagram illustration of the terminal set during connection of the free-end connector to the fixed-end connector.

Turning now to FIG. 7, the guiding system can be seen during the connection of connector housing 210 and plug housing 102. As will be realized from FIGS. 5 and 7, terminals 214 extend longitudinally within connector housing 210, and leaf spring 204 also extends longitudinally within connector housing 210 with leaf spring 204 positioned at the end of the row of terminals 214. Generally, there will be a pair of leaf springs, one located at opposing sides of the row of terminals 214, and hence at opposing ends of the free-end connector. Leaf spring 204 extends longitudinally farther than terminals 214 so that it comes into sliding relation with block guides 106 before terminals 214 can contact plug housing 102. That is, leaf spring 204 and block guides 106 interact to prevent terminals 214 from contacting plug housing 102 during the connection of connector housing 210 to plug housing 102. As will be better appreciated from FIG. 8, the relative alignment and length of terminals 214, leaf spring 204 and block guides 106 is such that terminals 214 are protected from impacting or contacting plug housing 102 during connecting of the fixed-end connector with free-end connector, especially during connections where the alignment begins at an angle. As FIG. 8 shows, if the connector housing 210 is introduced at angles as great as plus or minus 70 degrees, the terminals do not come in contact with plug housing 102 based on the relative length and positons of leaf spring 204 and block guides 106.

Figure 9:
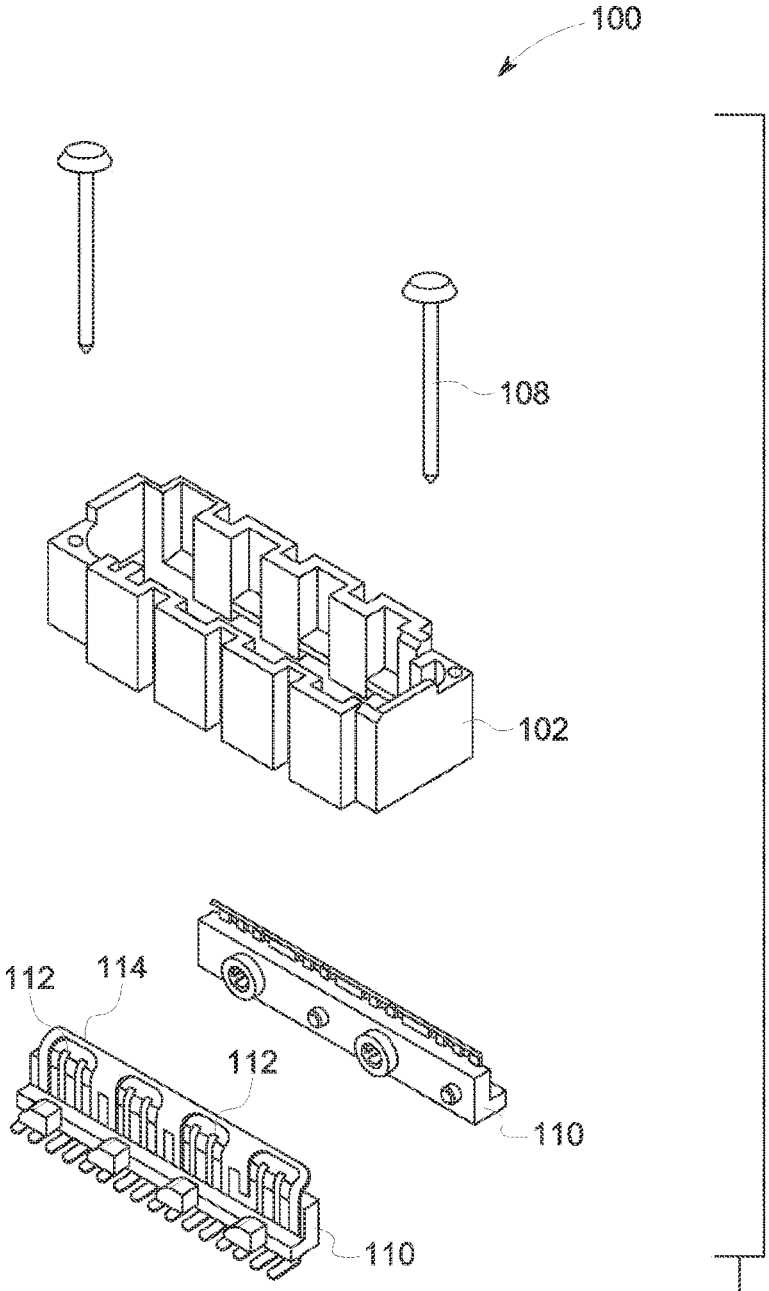
FIG. 9 is an exploded view of an embodiment of a fixed-end connector.
Figure 10A:
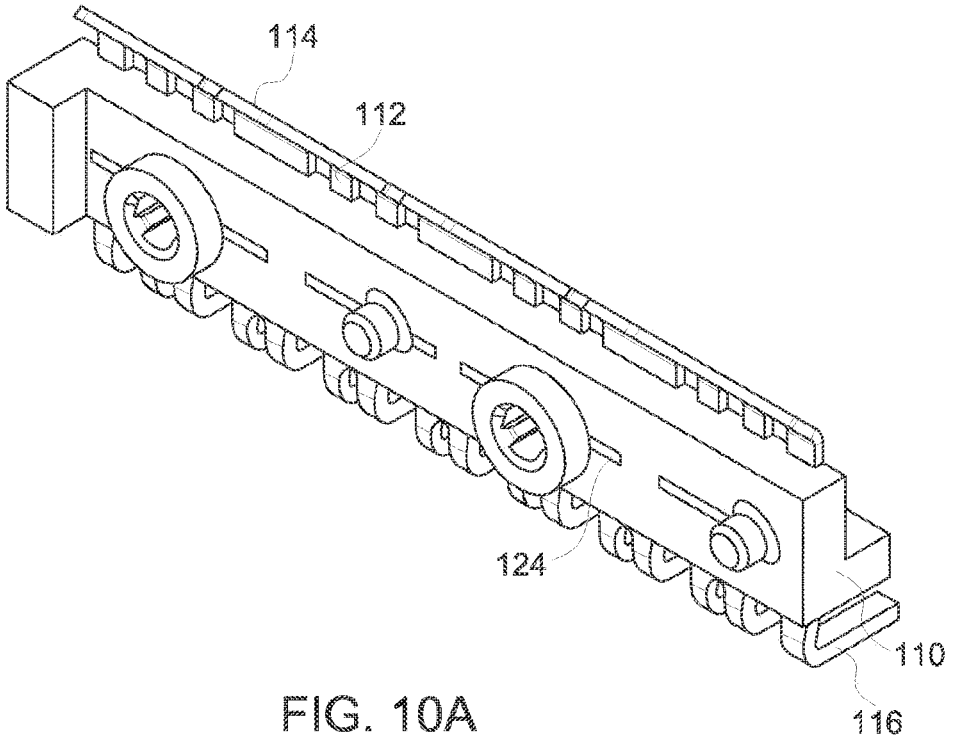
FIG. 10A is a view of the plug wafer of the embodiment of FIG. 9
Figure 10B:
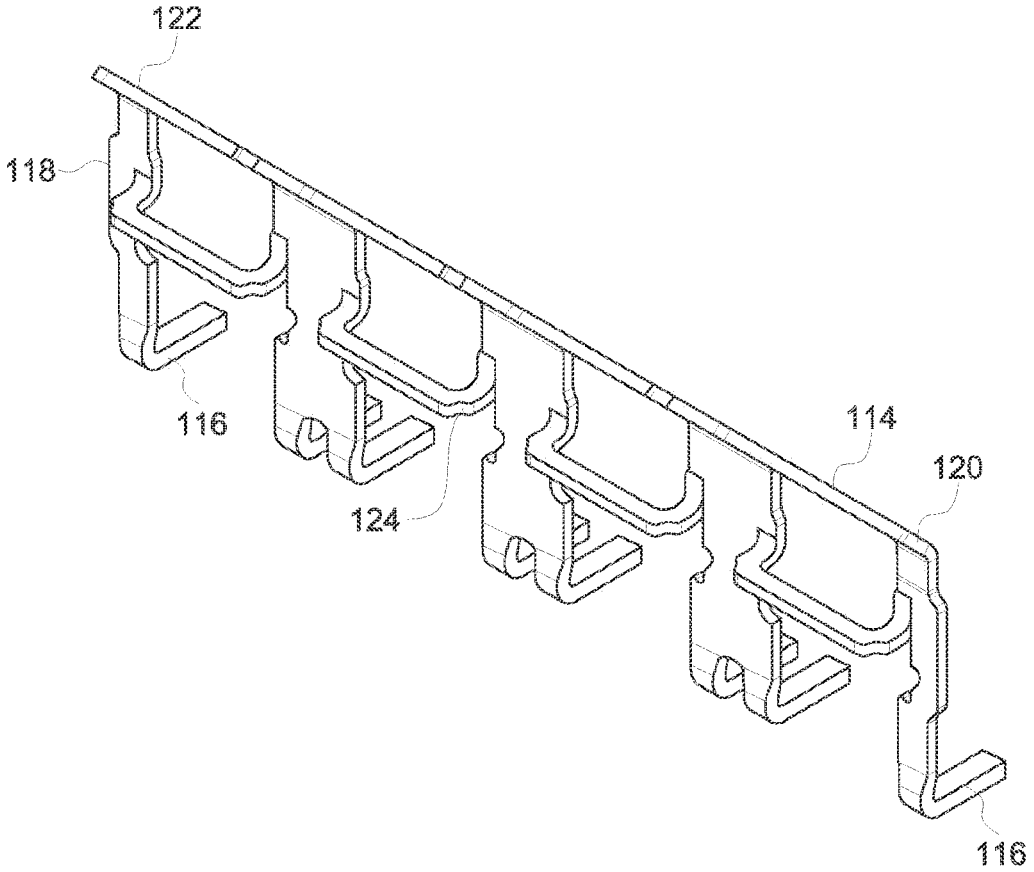
FIG. 10B is a view of the ground lead frame of the embodiment of FIG. 9.
Figure 11:
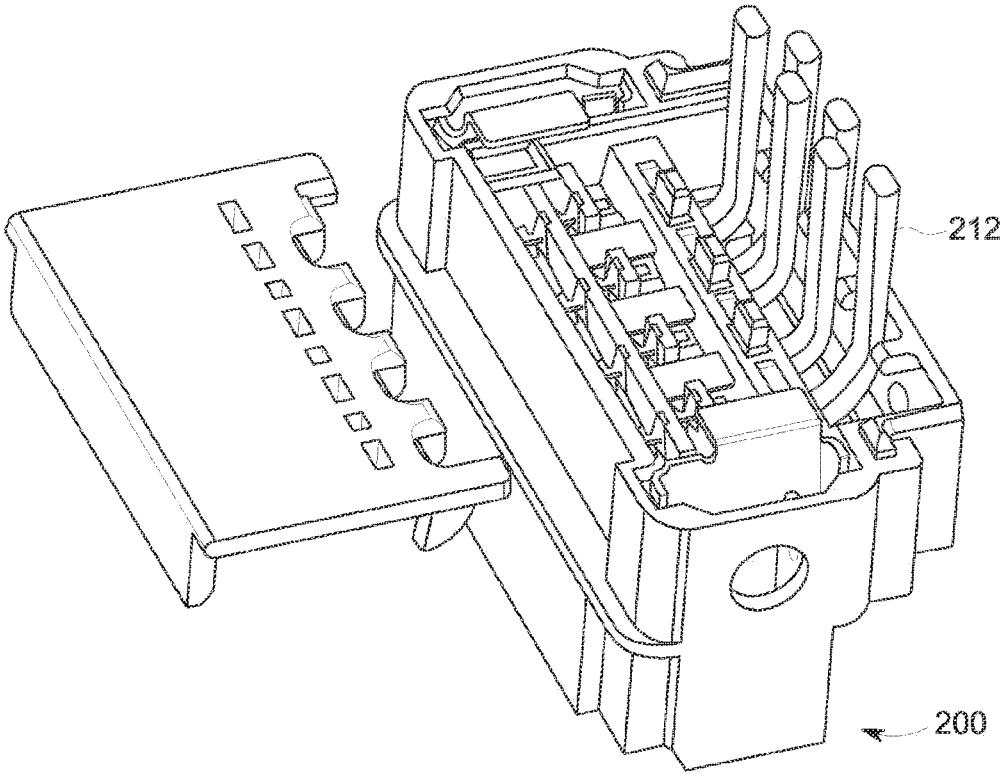
FIG. 11 is a perspective view of the free-end connector with part of the housing removed to better illustrate the twin-ax cable connections.

Turning now to FIGS. 9, 10A and 10B, further details of the fixed-end connector 100 can be seen. The depicted fixed-end connector 100 includes plug housing 102, which can be mounted to a circuit board with mounting stems 108. Within an internal area of the plug housing 102 are plug wafers 110. The plug wafers 110 can be joined together and as shown are joined with a hole and post type arrangement but other known mechanisms could also be used to join the wafers together. Mounted on or inserted molded in the plug wafers 110 are terminals, comprised of signal leads 112 and ground lead frame 114. The terminals can include tails 116—PCB (plug circuit board) contact ends—that are configured to be connected to a circuit board and in one configuration can be soldered to the circuit board. As best seen from FIG. 10B, ground lead frame 114 has a horseshoe shape such that a pair of signal leads 112 can be positioned within ground lead frame 114 so that there are ground leads on opposing sides of the signal leads. As will be realized from the below discussion, ground lead frame 114 can be in electrical contact with a ground terminal in free-end connector 200. Also, signal leads 112 can be in contact with signal terminals in free-end connector 200.

Figure 21:
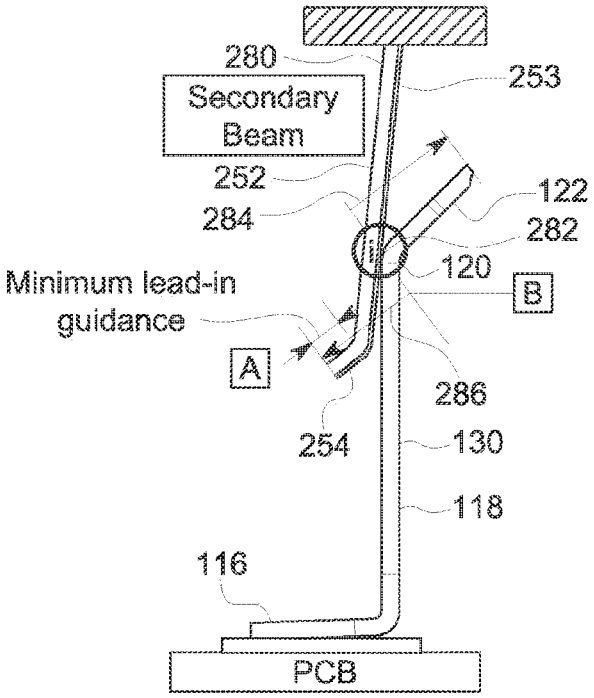
FIG. 21 is a schematic illustration of an embodiment of terminal connections and stub length.

As will be appreciated from FIG. 10B and as better seen in FIG. 21, ground leads and signal leads of the free end-connector can have basically a flat configuration except at tails 116 and at second end or tip 122. Basically, the leads have a straight beam portion 118 terminating at an approximately right angle tail 116 at one end and angled tip 122 at the other end. Straight beam portion 118 has a single cantilever forming a bend 120 such that a second end 122 extends at an angle from the straight beam portion 118. For ground lead frame 114, second end 122 can extend across the ground lead frame connecting each horseshoe shaped lead section as illustrated in FIG. 10B.

Additionally, the fixed-end connector can include ground communing. For example, shear-formed strap 124 can extend across each horseshoe shaped lead section to provide ground communing and in certain embodiments can also provide shielding. In an embodiment where the ground lead frame is insert molded into the wafer the edge of the shear form strap 124 can be exposed and this allows for greater distance between the shear form strap 124 and the signal terminals and thus potentially reduces the impedance impact because of the increased spacing between the shear form strap 124 and the signal terminals. Also, the fixed-end connector can include additional shielding to help provide superior electrical performance.

Figure 12:
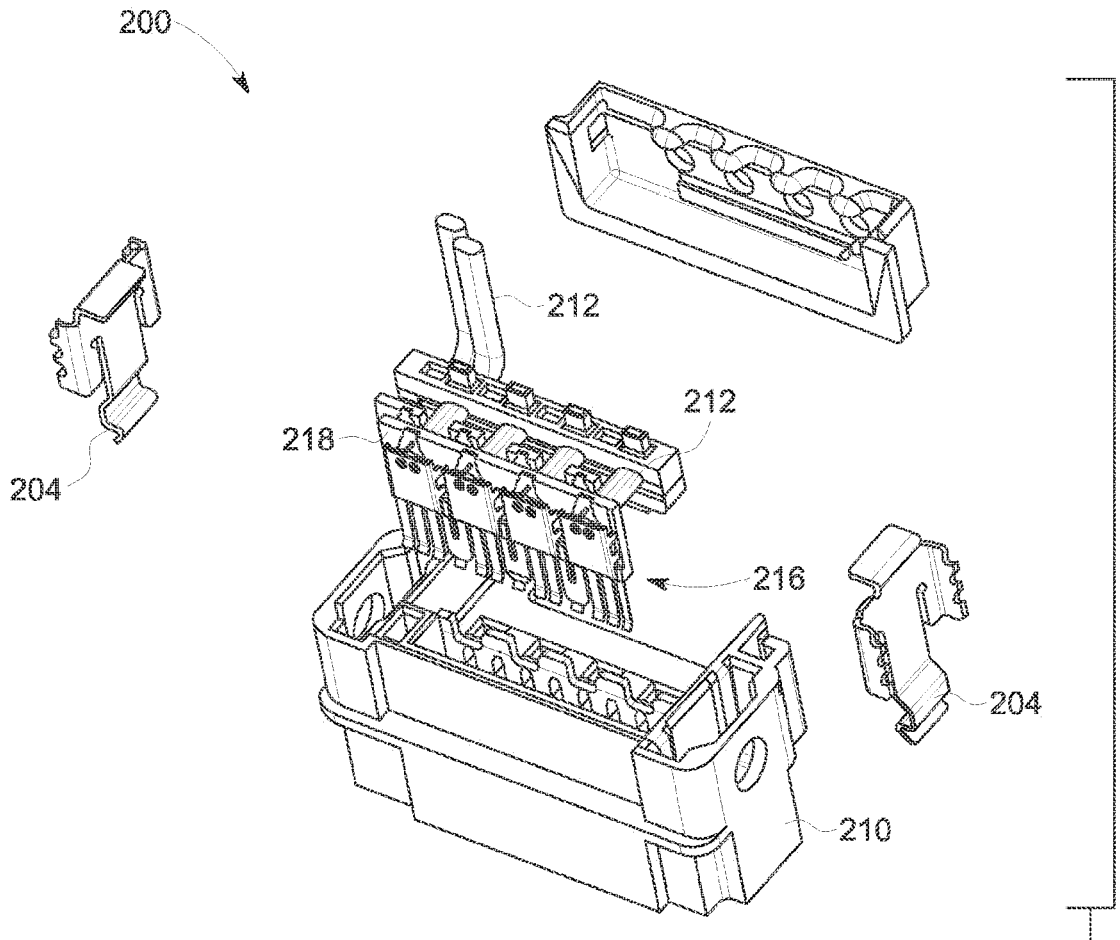
FIG. 12 is an exploded view of the free-end connector illustrated in FIG. 11.

Turning now to FIGS. 11-18, the free-end connector will be further described. As can be appreciated, the free-end connector connects conductive wires in twin-ax cable 202 (a first medium) to terminals set 216 in the free-end connector (a second medium). One issue with connecting conductive wires is managing the transition between conductors and terminals. In the prior art, the conductive wires, the free-end connector and the fixed-end connector have worked well but typically there is a noticeable impedance change at the transition. The depicted embodiment can significantly reduce any spikes or dips and helps provide improved performance. Specifically, as shown in FIG. 12, a terminal set 216 is configured to have the conductors of twin-ax cable 202 conductors be terminated at terminal set 216. Additionally, terminal set 216 is configured to provide a high performance channel from the cable conductors to mating leads 112, 114 (see FIG. 9), which can be referred to as a second terminal set, provided by appropriately configured fixed-end connector 100. In one embodiment, the depicted terminal set provides a ground-signal-signal-ground configuration supported by a frame 218 formed of an insulative material.

As seen from FIG. 12, frame 218 is positioned in the connector housing 210. As best seen from FIGS. 13, 16, 17 and 18, frame 218 has a first side 220 facing twin-ax cables 202 and a second side 222 opposite first side 220. Frame 218 includes a plurality of frame apertures 224 extending from first side 220 to second side 222.

Figure 13:
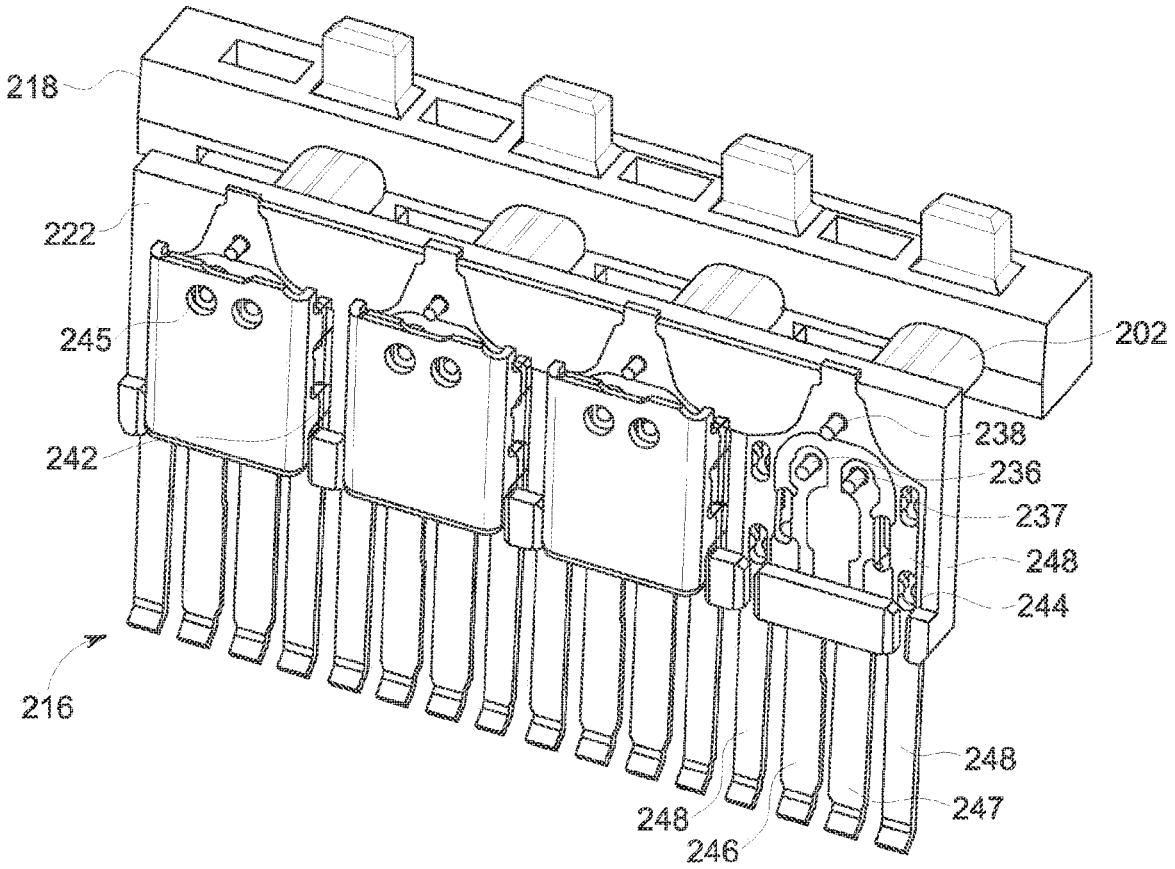
FIG. 13 is a perspective view of the frame and terminal set of the free-end connector illustrated in FIGS. 11 and 12.

Referring to FIG. 13, terminal set 216 is supported on second side 222 of frame 218. Terminal set 216 includes a first signal terminal 246, a second signal terminal 247 and a ground plate 248. As can be appreciated from FIG. 14, ground plate 248 has a horseshoe shape and provides a ground terminal on opposing sides of the first signal terminal 246 and second signal terminal 247. Further, ground plate 248 has a conductor aperture 258 and the first and second signal terminals 246, 247 can have conductor apertures 256, 257. Conductor apertures 256, 257 and 258 align with the frame apertures 224 when terminal set 216 is supported on frame 218. The conductor apertures are preferably sized so that a conductor can be inserted into the conductor aperture without having a friction/interference fit.

Figure 14:
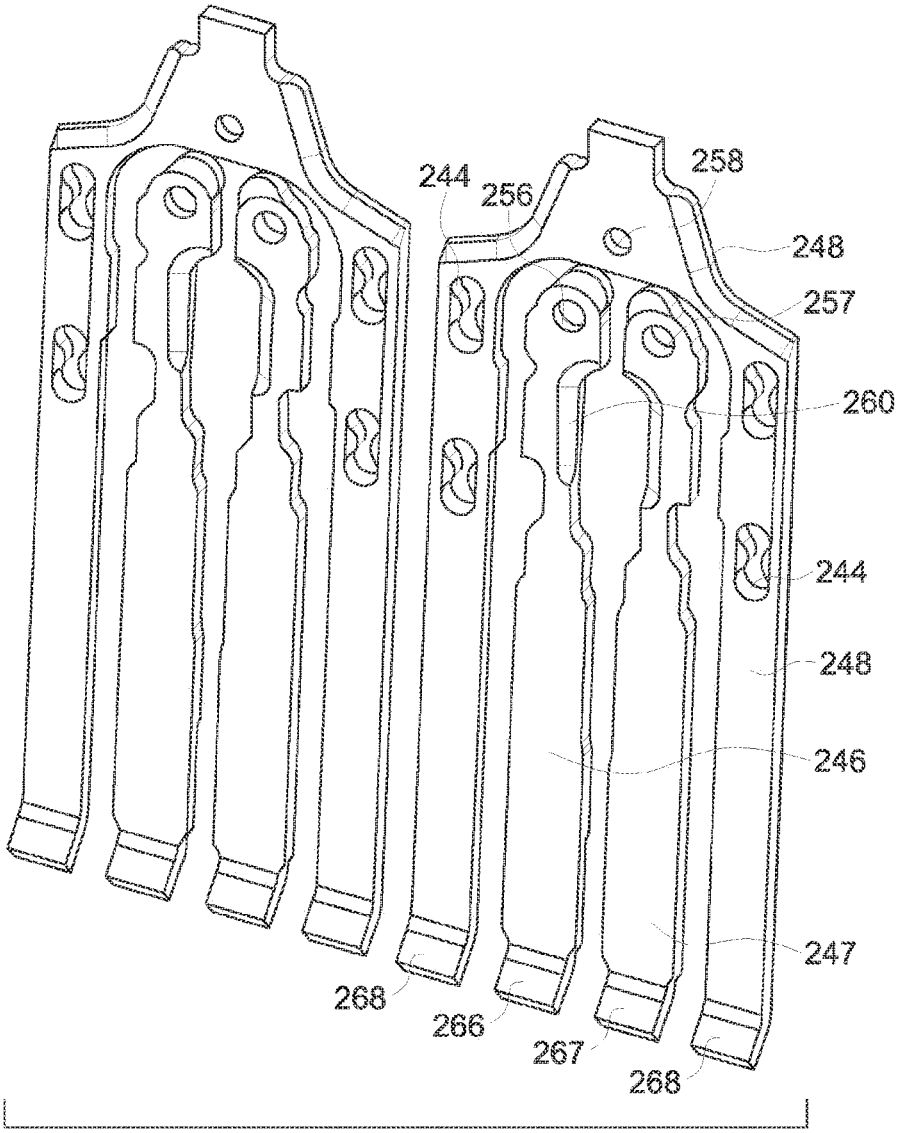
FIG. 14 is a perspective view of a portion of the terminal set of FIG. 13.
Figure 20:
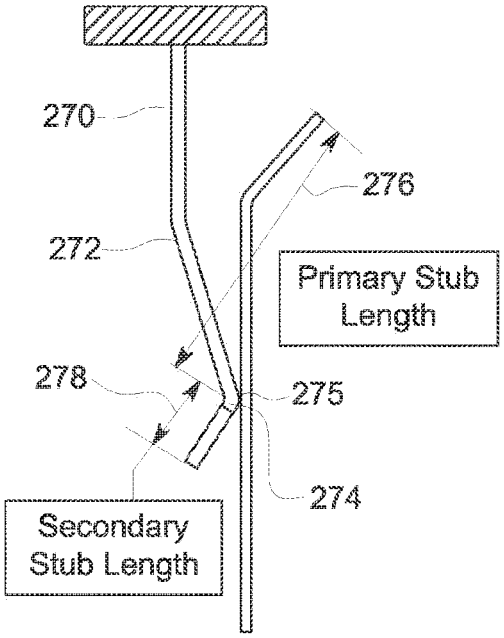
FIG. 20 (PRIOR ART)
FIG. 20 is a schematic illustration of the prior art terminal connections and stub length.

As can be further appreciated from FIGS. 14 and 21, each terminal 246, 247 and 248 can have a flat configuration except for tips 266, 267 and 268. Basically, each terminal 246, 247 and 248 (labeled generally as terminal 280 in FIG. 21) has a straight beam portion 252 having a first end 253, a second end 254 and a single cantilever such that the second end 254 extends at an angle from straight beam portion 252. Further, the first end 253 is in line with straight beam portion 252. In such embodiments, when the plug housing and connector housing are connected, lead 130 of the fixed-end connector contacts the associated terminal 280 of the free-end connector at a contact point 282 resulting in a primary stub length 284 and secondary stub length 286 of about equal length. This can be more clearly seen from a comparison of FIG. 20 with FIG. 21. FIG. 20 illustrates a prior art connection where a terminal 270 requires two cantilevers or bends 272 and 274 to make contact at point 275 with lead 126, which has a single bend 128 (not including any bend at the PCB contact end). As will be noted, the prior art has a primary stub length 276 which is considerably longer than the secondary stub length 278.

In comparison, FIG. 21 illustrates the contact between a terminal 280 and a lead 130 where terminal 280 and lead 130 each have the flat configurations described above with each having but a single bend or cantilever associated with producing contact between the them. (As will be appreciated, terminal 280 can be a ground terminal or signal terminal, and lead 130 can be a ground lead or signal lead.) This configuration results in a contact point 282 with primary stub length 284 and secondary stub length 286 of approximate equal length. A comparison with FIG. 20 also reveals that the total stub length (primary stub length plus secondary stub length) is less for the embodiment of FIG. 21 than for the prior art. The stubs create reflection of E&M transmissions, which create interference within the terminal/lead system. Such interferences are minimized by minimizing the stub lengths as illustrated in FIG. 21. Thus, the combined stub lengths can be minimized and any individual stub can be kept below a predetermined length that would be substantially less than the longest stub length of the prior art contact systems while still providing desirable wipe.

Returning now to FIG. 14, additional features of the signal terminals can be seen. Each of the depicted signal terminals 246, 247 can include one or more angled wedges 260 that are partially embedded into the frame 218. This helps secure signal terminals 246, 247 into position while providing a desirable coupling between the two signal terminals. This can be used to provide a differential coupling that is similar to the differential coupling that is provided between the two signal conductors of a twin-ax cable.

Figure 19:
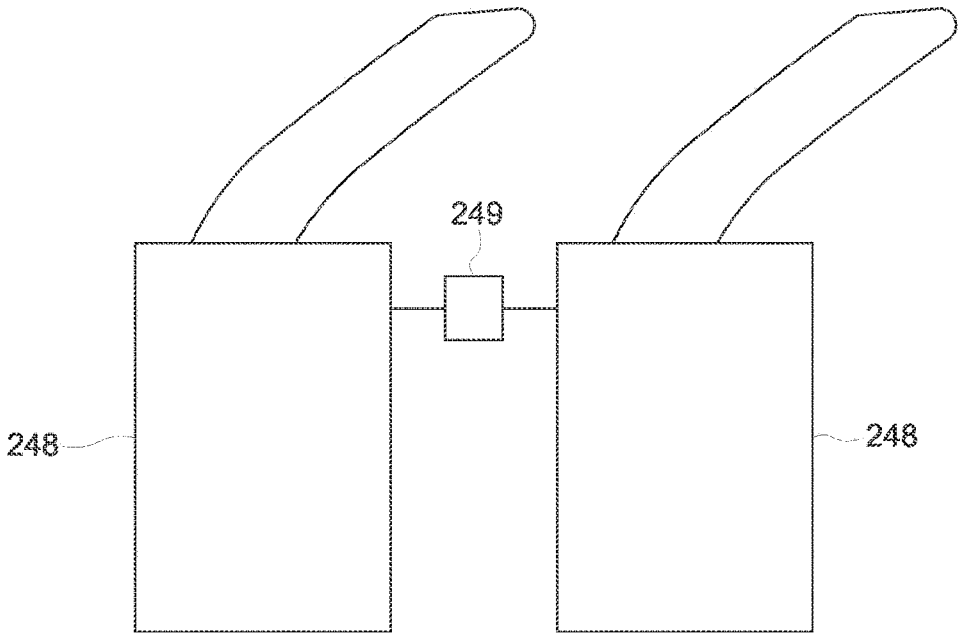
FIG. 19 schematically illustrates an embodiment of electrically connected ground plates.

As can be appreciated from FIG. 13, ground plate 248 with a horseshoe shape is supported by frame 218 and is configured to be connected to distal end 238 of a drain wire 228. The depicted embodiment uses a plurality of ground plates connected together to provide ground communing; however, in some embodiments the plurality of ground plates can be separated from each other electrically. In a further embodiment, a plurality of ground plates 248 could be provided and each ground plate can have a horseshoe terminal and the plurality of ground plates can be connected together by a network (such as is depicted schematically in FIG. 19). The network could be configured as desired and could range from a simple short to a passive circuit 249 (which could be one or more components such as a capacitor, a resistor, etc.) in a desired configuration. An active circuit could also be provided but generally is not as desirable due to cost issues.

Figure 15:
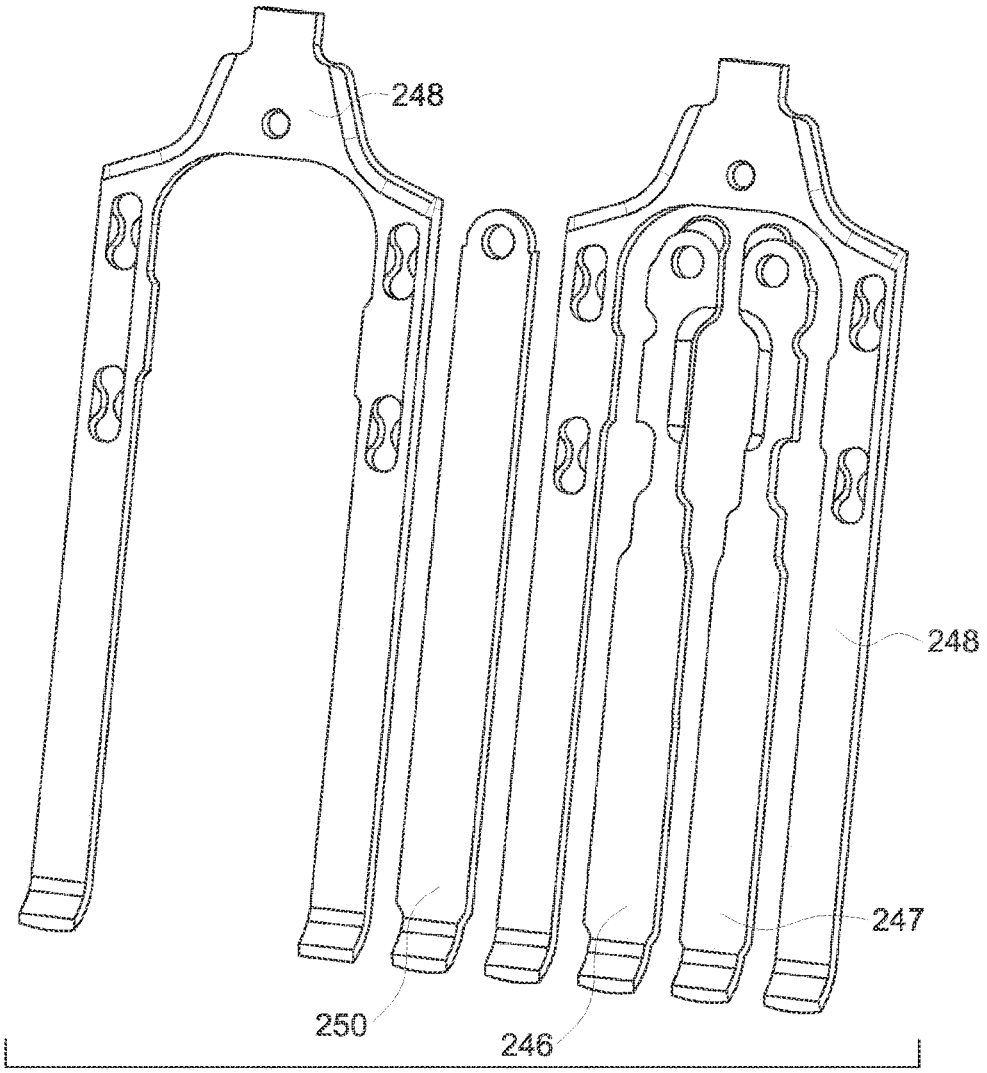
FIG. 15 is an alternative embodiment of a terminal set, which can be used in certain embodiments.

Additionally, while the terminal set depicted in FIG. 14 illustrates a ground-signal-signal-ground arrangement, in some embodiments additional terminals can be placed between adjacent ground plates 248. For example, an additional ground terminal 250 can be placed between ground plates 248, as illustrated in FIG. 15. This embodiment increases electrical isolation of a pair of signal terminals 246, 247 with respect to adjacent pairs of signal terminals.

Returning now to FIGS. 13, 16, 16A, 17 and 18, each twin-ax cable 202 generally includes a first signal conductor 226, as second signal conductor 227 and a drain wire 228. Additionally, an insulative material 230 surrounds signal conductors 226, 227 and twin-ax cable 202 has an outer covering 232. The first signal conductor 226, second signal conductor 227 and drain wire 228 each have a respective exposed distal end 236, 237 and 238, which extend from the insulative material and outer covering and which protrude through frame apertures 224.

Conductors (signal conductors 226, 227 and drain wire 228) from the twin-ax cables protrude through apertures 224. As can best be seen in FIG. 18, apertures 224 can be tapered and have a chamfer edge 224*a* to facilitate the movement of the distal end of the conductors and drain wire from the first side to the second side of the frame during insertion. Similarly the apertures 238, 256, 257 in the ground and signal terminals can be partially tapered by including an insertion edge, such as insertion edge 256*a* depicted in FIG. 18.

As indicated above, ground plate 248 and the first and second signal terminals 246, 247 can have conductor apertures aligned with the tapered apertures when the terminal set is on the frame. Thus as seen in FIG. 13, the distal end 238 of drain wire 228 extends through a frame aperture 224 and then through conductor aperture 258. Similarly, distal ends 236, 237 of first and second conductors 226, 227 extend through frame apertures 224 and then through conductor apertures 256, 257. The distal ends can be connected to their respective terminals via a weld or other known attachment technique (including soldering and conductive adhesives).

Figure 16:
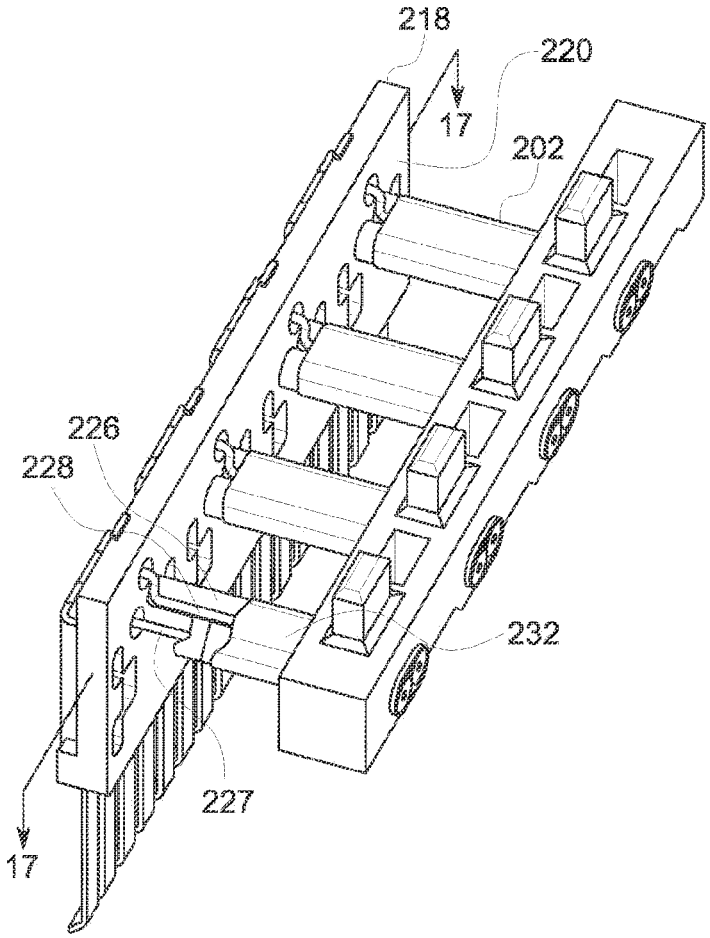
FIG. 16 is an illustration of the twin-ax cable connection to the frame and terminal set with a partial cut-a-way of one of the twin-ax cables.
Figure 16A:
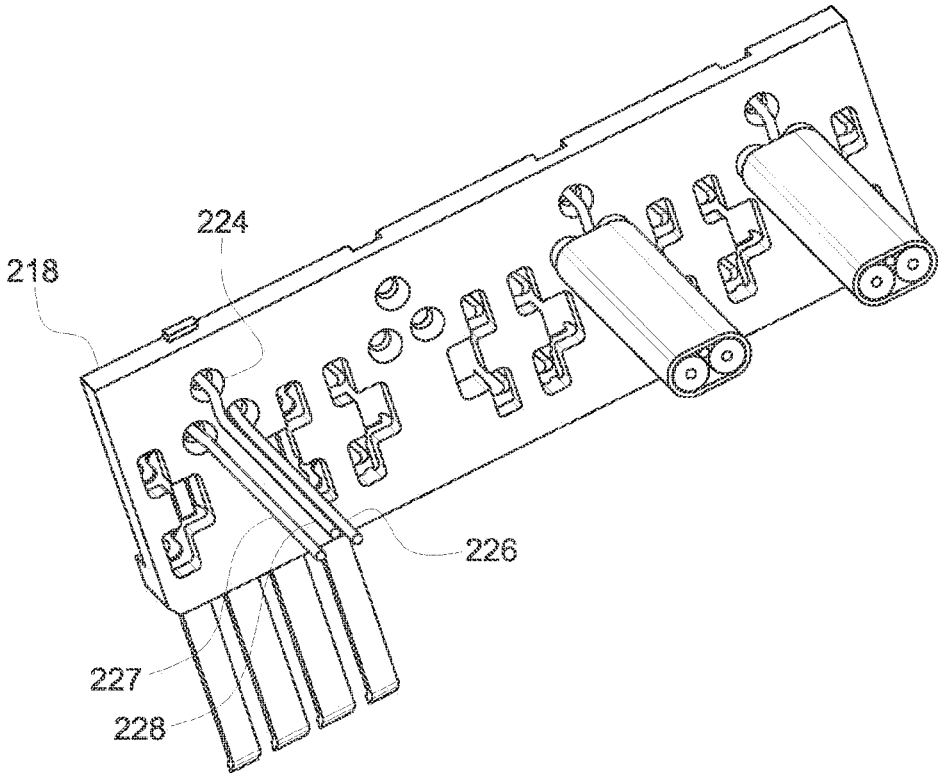
FIG. 16A is another perspective simplified view of the embodiment depicted in FIG. 16.
Figure 17:
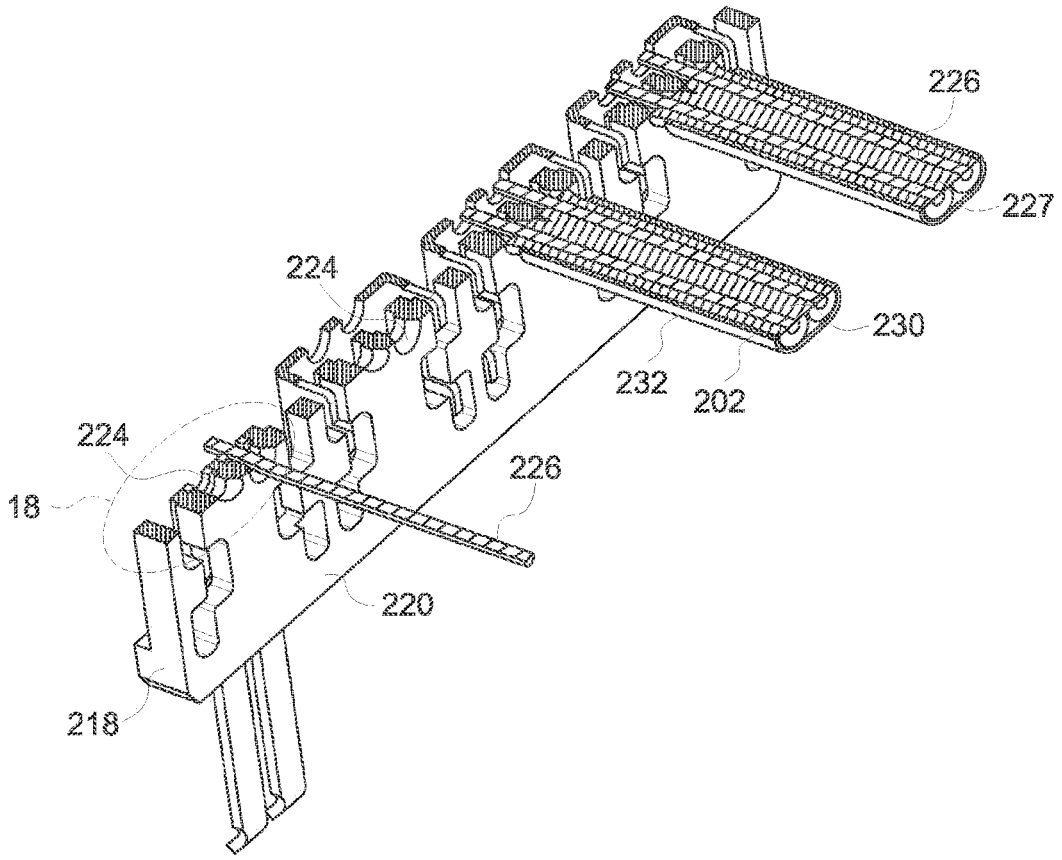
FIG. 17 is an illustration of the twin-ax cable connection taken along line 17-17 of FIG. 16.
Figure 18:
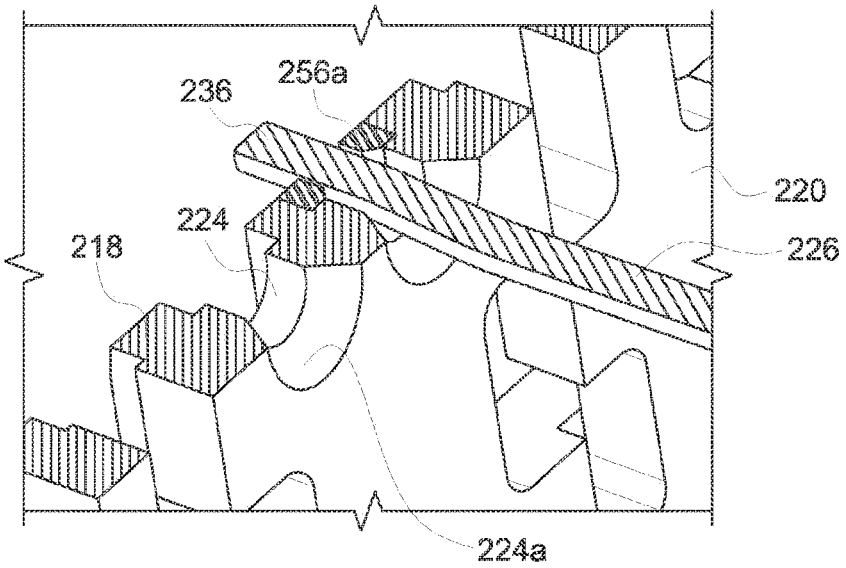
FIG. 18 is an enlarged view of the area 18 of FIG. 17.

As can be appreciated from FIG. 16A, the apertures in the frame 218 can be arranged in a triangular pattern with both signal apertures arranged side by side and equidistant from the intended mating surface while the ground aperture is arranged between and above the signal apertures. This triplet configuration helps ensure the coupling that exists in the cable between the signal conductors and the drain wire is maintained through the termination to the terminals 246, 247, 248. As a result, the termination works well from a signal performance standpoint even though there can be a 90-degree change of direction between the conductors in the cables and the terminals.

As can be appreciated from FIG. 13, shield covers 240 can be provided to improve the electrical performance of the system. In an embodiment, the shield covers 240 can include retention tabs 242 that engage retention apertures 244 in ground terminal plates 248 and thus can be mounted in place with a friction/interference fit. Alternatively, the shield covers 240 could be attached via a solder or welding operation or by using a conductive adhesive. The depicted shield covers have tuning apertures 245 aligned with distal ends 236, 237 of signal conductors 226, 227 to help improve the electrical performance of the system.

The above connector assembly can be produced by a method wherein a twin-ax cable is dressed to expose a distal end of a first conductor, a distal end of a second conductor and a distal end of a drain wire. The distal ends are then inserted through different frame apertures defined in a frame which is disposable into connector housing. As depicted, frame apertures are tapered to facilitate the movement of each distal end from a first side to a second side of the frame during insertion. Thereafter, each distal end is inserted into different conductor apertures of a terminal set supported on the opposing side of the frame from the twin-ax cable. Each conductor aperture is aligned with one of the frame apertures on a one-on-one basis. Thus, the first conductor extends through a first conductor aperture in a first signal terminal of the terminal set; the distal end of the second conductor extends through a second conductor aperture in a second signal terminal of the terminal set; and the distal end of the drain wire extends through a third conductor aperture in a ground plate of the terminal set. The ground plate has a horseshoe shape as described above. The distal ends are placed in electrical contact with their associated terminal as discussed above. Thus, the first conductor is in contact with the first signal terminal, the second conductor is in contact with the second signal terminal, and the drain wire is in contact with the ground plate. The method can further comprise placing a shield cover over the first and second signal terminals so that the shield cover is connected to the ground plate.

Also, the method can further comprise welding the first conductor to the first signal terminal at the first conductor aperture, welding the second conductor to the second signal terminal at the second conductor aperture and welding drain wire to the ground plate at the third conductor aperture.

In some embodiments, the method comprises introducing a leaf spring to a block guide on a plug housing during connection of the free-end connector to the fixed-end connector. The leaf spring extends longitudinally farther from the connector housing terminal set such that the leaf spring is guided by the block guides to prevent the terminal set contacting the plug housing. Thereafter, the connector housing is connected to the plug housing by interlocking the leaf spring with a locking ledge on the plug housing.

As will be appreciated by those skilled in the art, the above disclosure provides for a wire-to-board system which can be provided in compact configuration and which supports high data rates.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. A connector assembly, comprising a free-end connector having:

a twin-ax cable including a first conductor and a second conductor spaced apart and surrounded by an insulative material, and including a drain wire and outer covering, the first conductor having an exposed distal end extending from the insulative material, the second conductor having an exposed distal end extending from the insulative material, and the drain wire having an exposed distal end;

a connector housing that supports the twin-ax cable;

a frame positioned in the connector housing, the frame having a first side and a second side opposite the first side, and including a plurality of frame apertures extending from the first side to the second side; and a terminal set supported on the second side of the frame, the terminal set including a first signal terminal, a second signal terminal and a ground plate, wherein the ground plate has a horseshoe shape and provides a ground terminal on opposing sides of the first and second signal terminals, wherein the first conductor extends through a first aperture of the plurality of frame apertures and is connected to the first signal terminal, the second conductor extends through a second aperture of the plurality of fame apertures and is connected to the second signal terminal, and the drain wire extends through a third aperture of the plurality of frame apertures and is connected to the ground plate.

2. The connector assembly of claim 1, wherein the plurality of frame apertures are tapered so as to facilitate the movement of the distal end of the conductors and drain wire from the first side to the second side of the frame during insertion.

3. The connector assembly of claim 2, wherein the ground plate and the first and second signal terminals have conductor apertures aligned with the tapered apertures, and wherein the first conductor is connected at the conductor aperture to the first signal terminal, the second conductor is connected at the conductor aperture to the second signal terminal, and the drain wire is connected at the conductor aperture to the ground plate.

4. The connector assembly of claim 3, wherein the first conductor is welded to the first signal terminal at the conductor aperture, and the second conductor is welded to the second signal terminal at the conductor aperture.

5. The connector assembly of claim 1, wherein a shield cover is positioned over the first and second signal terminals and is connected to the ground plate.

6. The connector assembly of claim 5, wherein the shield cover includes a first tuning aperture aligned with the conductor aperture in the first signal terminal, and a second tuning aperture aligned with the conductor aperture in the second signal terminal.

7. The connector assembly of claim 1, further comprising a fixed-end connector having a plug housing wherein the connector housing and plug housing interlock by interaction of a leaf spring and locking ledge.

8. The connector assembly of claim 7, wherein the connector housing includes the leaf spring that interlocks with the locking ledge on the plug housing.

9. The connector assembly of claim 8, wherein:

the plug housing further comprises at least a pair of block guides so as to provide at least one block guide on opposing sides of the locking ledge;

the leaf spring extends longitudinally farther from the connector housing than the terminal set such that the leaf spring is guided by the block guides so as to prevent the terminal set contacting the plug housing during connection of the connector housing to the plug housing.

10. The connector assembly of claim 1, further comprising a fixed-end connector having:

a plug housing, wherein the connector housing and plug housing are configured to connect together;

a plug wafer positioned in the plug housing;

a ground lead frame carried on the plug wafer, the ground lead frame having a horseshoe shape; and a pair of signal leads positioned within said ground lead frame so that there are ground leads on opposing sides of the pair of signal leads, wherein the ground lead frame is in electrical contact with the ground terminal and one of the signal leads is in contact with the first signal terminal and the other signal lead is in contact with the second signal terminal.

11. The connector assembly of claim 10, wherein:

a first signal lead of the pair of signal leads has a PCB contact end, a straight beam portion extending perpendicular to the PCB contact end and wherein the straight beam portion has a single cantilever forming a bend such that a second end extends at an angle from the straight beam portion; and the first signal terminal is a straight beam having a first end, a second end and a single cantilever such that the second end extends at an angle from the straight beam and the first end is in line with the straight beam, wherein when the plug housing and connector housing are connected, the first signal lead contacts the first signal terminal at a contact point resulting in a primary stub length and a secondary stub length of about equal length.

12. The connector assembly of claim 11, wherein the connector housing and plug housing interlock by interaction of a leaf spring and locking ledge, wherein the connector housing includes the leaf spring that interlocks with the locking ledge on the plug housing.

13. The connector assembly of claim 12, wherein the plug housing further comprises a block guides so as to provide at least one block guide on opposing sides of the locking ledge and the leaf spring extends longitudinally farther from the connector housing than the terminal set such that the leaf spring is guided by the block guides so as to prevent the terminal set contacting the plug housing during connection of the connector housing to the plug housing.

14. The connector assembly of claim 13, wherein the plurality of frame apertures are tapered so as to facilitate the movement of the distal end of the conductors and drain wire from the first side to the second side of the frame during insertion.

15. The connector assembly of claim 14, wherein the ground plate and the first and second signal terminals have conductor apertures aligned with the tapered apertures, and wherein the first conductor is connected at the conductor aperture to the first signal terminal, the second conductor is connected at the conductor aperture to the second signal terminal, and the drain wire is connected at the conductor aperture to the ground plate.

16. The connector assembly of claim 15, wherein a shield cover is positioned over the first and second signal terminals and is connected to the ground plate, and wherein the shield cover includes a first tuning aperture aligned with the conductor aperture in the first signal terminal, and a second tuning aperture aligned with the conductor aperture in the second signal terminal.

17. The connector assembly of claim 16, wherein the connector includes at least two adjacent pairs of first and second terminals and corresponding ground plates and the adjacent ground plates are connected by a network that extends between the adjacent ground plates.

18. A method of producing a connector assembly comprising:

providing a twin-ax cable including a first conductor and second conductor surrounded by an insulative material, and including a drain wire;

dressing the cable whereby a distal end of the first conductor, a distal end of the second conductor and a distal end of the drain wire are exposed;

inserting the distal end of the first conductor through a first aperture in a frame in a connector housing, inserting the distal end of second conductor through a second aperture in the frame and inserting the distal end of the drain wire through a third aperture in the frame, wherein the first, second and third apertures are tapered so as to facilitate the movement of each distal end from a first side to a second side of the frame during insertion;

thereafter, inserting the distal end of the first conductor through a first conductor aperture in a first signal terminal of a terminal set supported on the second side of the frame, inserting the distal end of the second conductor through a second conductor aperture in a second signal terminal of the terminal set, and inserting the distal end of the drain wire through a third conductor aperture in a ground plate of the terminal set, wherein the ground plate has a horseshoe shape and provides a ground terminal on opposing sides of the first and second signal terminals; and placing the distal end of the first conductor in contact with the first signal terminal, placing the distal end of the second conductor in contact with the second signal terminal, and placing the drain wire in contact with the ground plate.

19. The method of claim 18, further comprising placing a shield cover over the first and second signal terminals so that the shield cover is connected to the ground plate.

20. The method of claim 19, further comprising welding the first conductor to the first signal terminal at the first conductor aperture, welding the second conductor to the second signal terminal at the second conductor aperture and welding the drain wire to the ground plate at the third conductor aperture.

21. A plug connector, comprising:

a housing that forms an internal area and includes two locking edges provided on opposite sides of the housing; and a first plug wafer and a second plug wafer positioned in the internal area, the first and second plug wafers each including a plurality of signal terminals and a ground lead frame, the ground lead frame providing a plurality of U-shaped arrangements, each U-shaped arrangement extending around pairs of signal terminals and that further includes a tail that is positioned on both sides of the corresponding pair of signal terminals, the ground lead frame further including a plurality of shear formed straps that are each configured to extend transversely past one of the pairs of signal terminals positioned in the plug wafers, wherein the ground lead frame is insert molded into the wafer.

22. The plug connector of claim 21, wherein the shear formed straps extend to the surface of the plug wafers and are partially exposed.

23. The plug connector of claim 22, wherein the first and second plug wafer are joined together.

* * * * *